US006899030B2

(12) United States Patent
Fowlkes et al.

(10) Patent No.: US 6,899,030 B2
(45) Date of Patent: May 31, 2005

(54) LITHOGRAPHIC PLATE IMAGING SYSTEM TO MINIMIZE PLATE MISREGISTRATION FOR MULTICOLOR PRINTING APPLICATIONS

(75) Inventors: William Y. Fowlkes, Pittsford, NY (US); Charles D. DeBoer, Palmyra, NY (US); Paul D. Heppner, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 44 days.

(21) Appl. No.: 10/429,676

(22) Filed: May 5, 2003

(65) Prior Publication Data

US 2004/0221757 A1 Nov. 11, 2004

(51) Int. Cl.[7] ..... B41C 1/10
(52) U.S. Cl. ..... 101/466; 101/467; 101/486
(58) Field of Search ..... 101/463.1, 465, 101/466, 467, 401.1, 485, 486, DIG. 36

(56) References Cited

U.S. PATENT DOCUMENTS

| | | | | |
|---|---|---|---|---|
| 5,163,368 A | | 11/1992 | Pensavecchia et al. | 101/136 |
| 5,434,646 A | * | 7/1995 | Talts | 355/53 |
| 5,550,574 A | * | 8/1996 | Dillow | 347/262 |
| 5,820,932 A | * | 10/1998 | Hallman et al. | 427/261 |
| 5,865,118 A | | 2/1999 | Fromson et al. | 101/463.1 |
| 5,934,195 A | * | 8/1999 | Rinke et al. | 101/401.1 |
| 6,076,464 A | * | 6/2000 | Okamura | 101/401.1 |
| 6,164,757 A | | 12/2000 | Wen et al. | 347/43 |
| 6,174,936 B1 | | 1/2001 | Kato | 523/160 |
| 6,283,019 B1 | * | 9/2001 | Dolves | 358/3.29 |
| 6,352,330 B1 | | 3/2002 | Lubinsky et al. | 347/15 |
| 6,464,330 B1 | | 10/2002 | Miller et al. | 347/40 |
| 2002/0081526 A1 | | 6/2002 | Christall et al. | 430/302 |
| 2002/0126189 A1 | | 9/2002 | Gloster | 347/100 |

FOREIGN PATENT DOCUMENTS

| | | |
|---|---|---|
| EP | 0 503 621 A1 | 3/1992 |
| EP | 0 697 282 B1 | 12/1998 |
| EP | 0 965 444 A1 | 12/1999 |
| EP | 0 976 567 A2 | 2/2000 |

* cited by examiner

*Primary Examiner*—Stephen R. Funk
(74) *Attorney, Agent, or Firm*—Norman Rushefsky; Mark G. Bocchetti

(57) ABSTRACT

A method and apparatus of producing images on a series of master plates that are suitable for use as printing plates for the reproduction of multiple copies of composite images from said plates. The master plates are supported with a predetermined alignment relative to each other before mounting on a printing press. Counterpart raster lines of images on the master plates are recorded simultaneously or substantially simultaneously using preferably an ink jet printer so that the counterpart raster lines are printed in alignment.

28 Claims, 10 Drawing Sheets

LITHOGRAPHIC PLATE IMAGING SYSTEM TO MINIMIZE PLATE MISREGISTRATION FOR MULTICOLOR PRINTING APPLICATIONS

BACKGROUND OF THE INVENTION

The invention relates in general to a lithographic plate imaging apparatus and method such as that using an inkjet printhead(s). The apparatus and method utilize a plate transport system designed to transport a group of plates locked together and a wide format inkjet plate printer to image all plates in unison. This technique minimizes interplate skew and misregistration. In a preferred embodiment a carrier type fixture is employed to align the plate media such that the group of plates are positioned so that swaths or raster lines of color separation images are laid down upon the plate media in alignment to a reference edge of the plate group and that skew and misregistration of the images in reference to the edge is minimized.

Modern printing relies heavily on inkjet printing techniques. The term "inkjet" as utilized herein is intended to include all drop-on-demand or continuous inkjet printer systems including, but not limited to, thermal inkjet, piezoelectric, and continuous, all of which are well known in the printing industry. Essentially, an inkjet printer produces images on a receiver medium, such as paper, by ejecting ink droplets onto the receiver medium in an image-wise fashion. The advantages of non-impact, low-noise, low-energy use, and low cost operation, in addition to the capability of the printer to print on plain paper, are largely responsible for the wide acceptance of inkjet printers in the marketplace. This application involves the use of a type of inkjet printer specifically designed to image lithographic printing plates.

Digital computer-aided design of graphical material or text is well known. Electronically derived images of words or graphics presented on a CRT or other type of digital display of a digital computer system can be edited and converted to final hard copy by direct printing with impact printers, laser printers or inkjet printers. This manner of printing or producing hard copy is extremely flexible and useful when printing relatively small print runs. However for larger print runs, printing on printing presses using lithographic plates is still the preferred process. In such a printing process lithographic plates having different color separation images of the desired composite printed image to be formed are each separately imaged and mounted on a printing press in association with respective inking rollers as part of a respective color station. A composite multicolor print is made by moving a sheet, such as of paper, plastic or fabric, to accept respective color ink images from the respective color stations. Typically a respective blanket roller at each color station receives an ink image from a respective lithographic plate, mounted on a printing cylinder or support, which plate selectively receives ink in accordance with an oleophilic image pattern formed thereon.

Fabrication of lithographic plates to form images thereon by inkjet techniques is known. In this regard an inkjet system may be used to apply an oleophilic liquid to form an image on a hydrophilic aluminum surface of a lithographic plate. Additionally other variants include direct deposit of the inkjet image as a hydrophobic image on the plate. Various types of lithographic plate fabrication are described in U.S. 2002/0126189 A1.

A major advantage of lithographic plate fabrication using inkjet is the relatively low cost of producing the imaged lithographic plate. Wide format inkjet printers can be used to inexpensively print specially prepared plates that have nominal dimensions of say 17"×23." One of the key requirements for the image on the plate is good registration of the image to the plate and very good registration between images when printed on the press. Small errors in image to plate location can be compensated for in the press, by adjusting the location of the plate, but errors within an image can not be easily compensated. Such errors can come from variation in the printing process in the fast scan direction or the slow scan direction. Variations in the image that are reproduced on all four plates will not cause registration errors, but any differential errors (errors that are different from plate to plate) will result in registration errors when the color separations are applied to paper in the press.

Typical wide format printers have precise motion control of the printhead assembly with placement accuracy as high as 1/2400 inch. This is required to prevent banding artifacts and to achieve high productivity levels. Typical wide format printers have relatively simple receiver transport systems. The key requirement is to avoid banding by proper placement of the receiver for each pass of the printhead assembly. The low mass, low speed and short transport distances and the fact that the receiver moves only between printing passes and is held fixed during printing allows for low cost designs such as scuff rollers to transport the receiver. Typical placement accuracy requirements may be only 1/600 inch.

Transport of aluminum plates, which may be as thick as 0.012", that cannot bend easily and may have a lower coefficient of friction than paper causes platesetter designers to invest in much more expensive solutions for plate transport. It would be desirable to maintain the low cost and simple design of a wide format inkjet printer while avoiding differential transport variation that will result in poor image registration on the press.

What is needed then is an economical method to register the images on the lithographic plate during inkjet imaging in an economical fashion. It is also desirable to print the plates as fast as possible, since many applications require fast plate production rates.

SUMMARY OF THE INVENTION

The present invention provides a method for imaging multiples of lithographic plates so that the multiples of plates are registered relative to each other during recording of images thereon before mounting on the press. An aspect of this invention is that the imaging apparatus or platesetter is designed to minimize plate to plate registration and skew errors. Alternative examples of retaining the plates in a registered position are presented. Although one inkjet printhead may be used multiple ink jet print heads may be provided to maximize platesetter productivity.

BRIEF DESCRIPTION OF THE DRAWINGS

For a more complete understanding of the present invention, including its features and advantages, reference is made to the following detailed description of the invention, taken in conjunction with the accompanying drawings in which.

Corresponding numerals and symbols in these figures refer to corresponding parts in the detailed description unless otherwise indicated.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. For example, the specific embodiments discussed herein are described in the context of imaging lithographic plates using an inkjet printhead. It should understood, however, that imaging lithographic or flexographic plates or other types of master plates with other types of recording elements such as LEDs, thermal recording elements, and lasers, among others may benefit from the advances provided by the invention. The specific examples discussed herein are merely illustrative of specific ways to make and use the invention, and do not delimit the scope or application of the invention.

Figure 1:
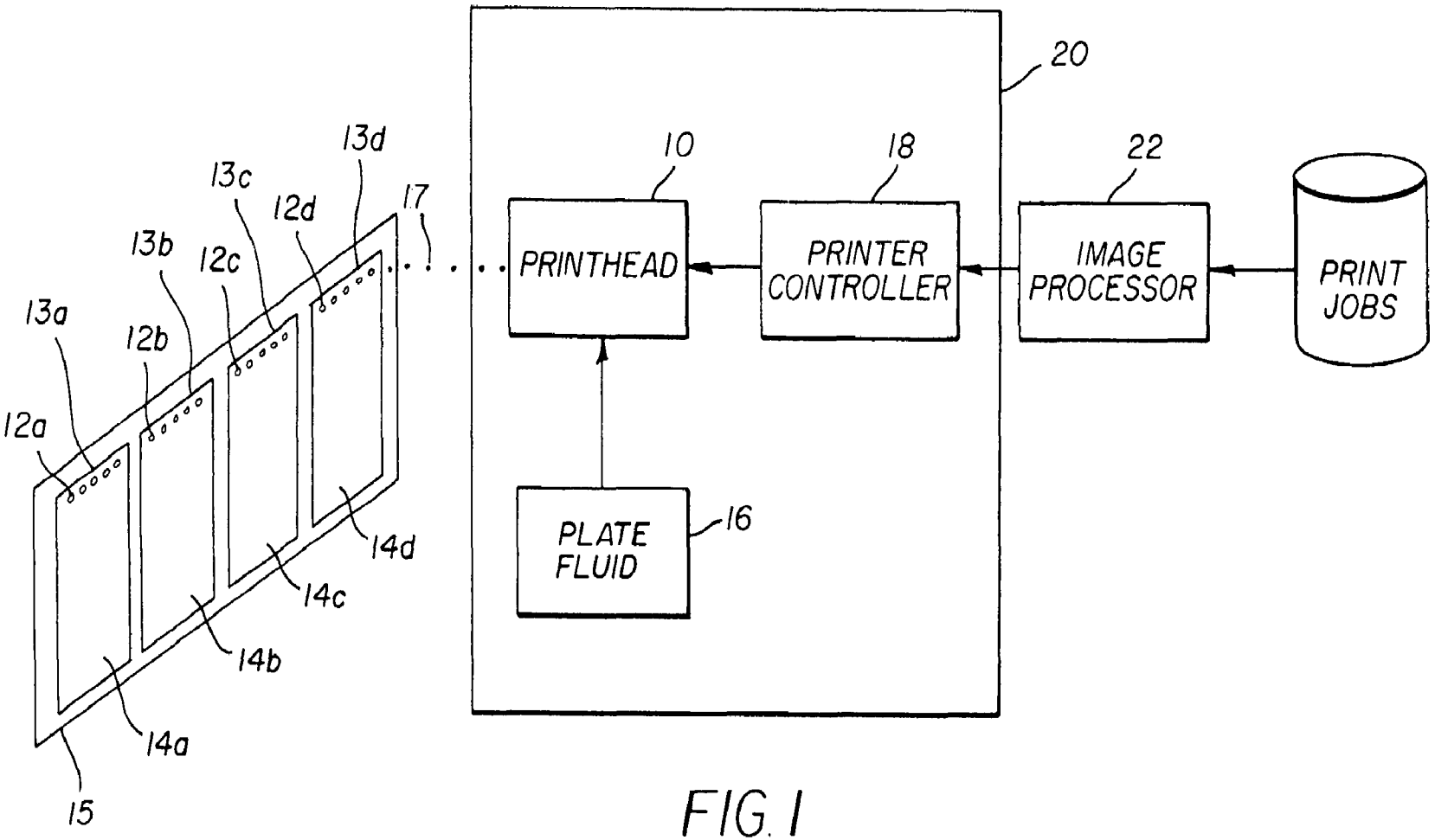
FIG. 1 is a diagram illustrating a lithographic plate imaging system utilizing a wide format inkjet printer in accordance with the invention.

Referring to FIG. 1, therein is shown a block diagram of an inkjet imaging system or printing system for lithographic plates. Inkjet printhead 10 applies a stream of plate fluid drops 17 to as many as four lithographic plates 14*a,b,c* and *d* to form the image or oleophilic regions of the printing plates. The plate coating or nonimaged portion of the plate forms the hydrophilic region of the plate. Typically, printing jobs in electronic form are presented to an image processor 22 where the images are rasterized and transferred to a printer controller 18. At the printer controller, portions of the image or swaths of image data are allocated to each pass of the print head over the plate. These swaths of data are converted into electronic signal form and actuate the printhead 10 to generate drops of plate fluid that are jetted or otherwise released from the printhead 10 and deposited onto plates 14*a–d*. A supply of plate fluid is stored in a reservoir 16 that is in fluid communication with the printhead 10.

Figure 4:
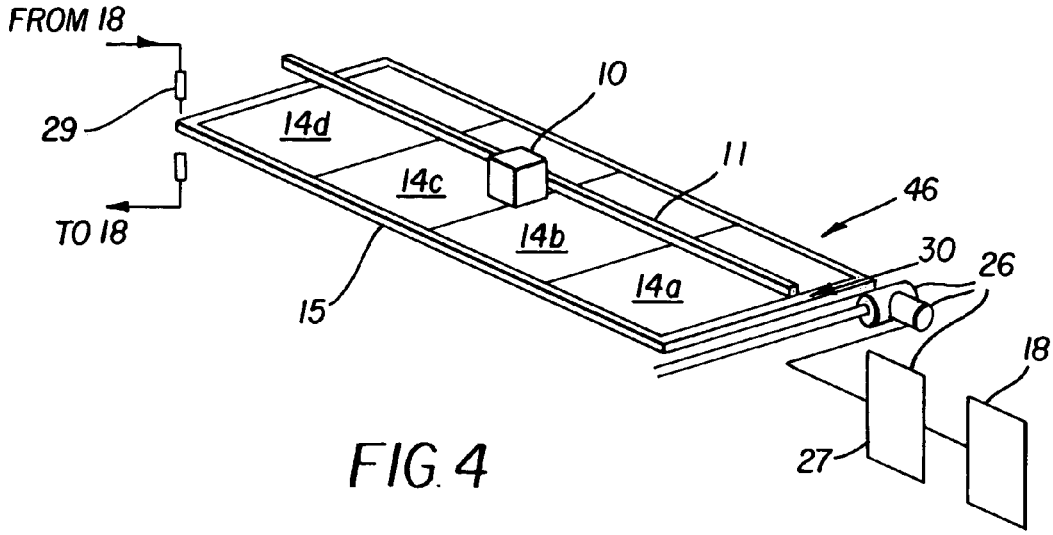
FIG. 4 is an illustration of a lithographic plate transport system for use in the imaging system of FIG. 1.

The printhead 10, printer controller 18, and source of plate fluid 16 are part of the printer system also known as a platesetter. In FIG. 1, lithographic plates 14*a–d* are shown commonly supported on a plate carrier 15 with their respective leading edges 13*a,b,c* and *d* being aligned and there is further shown respective counterpart first raster rows 12*a,b,c* and *d* having respective drops printed thereon by the printhead 10. Further details regarding the printhead 10 are illustrated in FIG. 4 wherein a single printhead is traversed across a rail 11 to deposit liquid drops at selected locations on each of the four lithographic plates substantially simultaneously, this term implying that each of the four plates has a counterpart raster row printed during the same pass of the inkjet printhead 10. An example of a scanning printhead that advances along a carriage may be found in commonly assigned U.S. Pat. No. 6,464,330, entitled "Ink Jet Printer With Improved Dry Time" filed in the name of Miller et al. It will be noted that such printhead has one or more rows of nozzles that are capable of depositing liquid drops at selected locations according to image data. As an example only, the printhead may comprise several hundred nozzles spaced at a respective pitch spacing of say 1/300". Multiple passes of the printhead may be also used to deposit a full swath of liquid drops at selected locations to complete a region of imaging on each lithographic plate.

Preferably, the image printed on each of the lithographic plates comprises an oleophilic image that is formed by applying to the support an aqueous solution or aqueous colloidal dispersion of a polymer having water-solublising groups that interact with the surface of the support thereby binding the polymer to the support and rendering the support usable as a lithographic printing plate when the plate is mounted on a printing press. The aqueous solution or aqueous colloidal yield dispersion of polymer may comprise pigment particles dispersed therein as described in commonly assigned U.K. application number 0217978.6, filed Aug. 2, 2002, filed in the name of Chen et al. and entitled "Method and Composition for the Preparation of a Printing Plate," the contents of which are incorporated herein by reference.

Figure 2A:
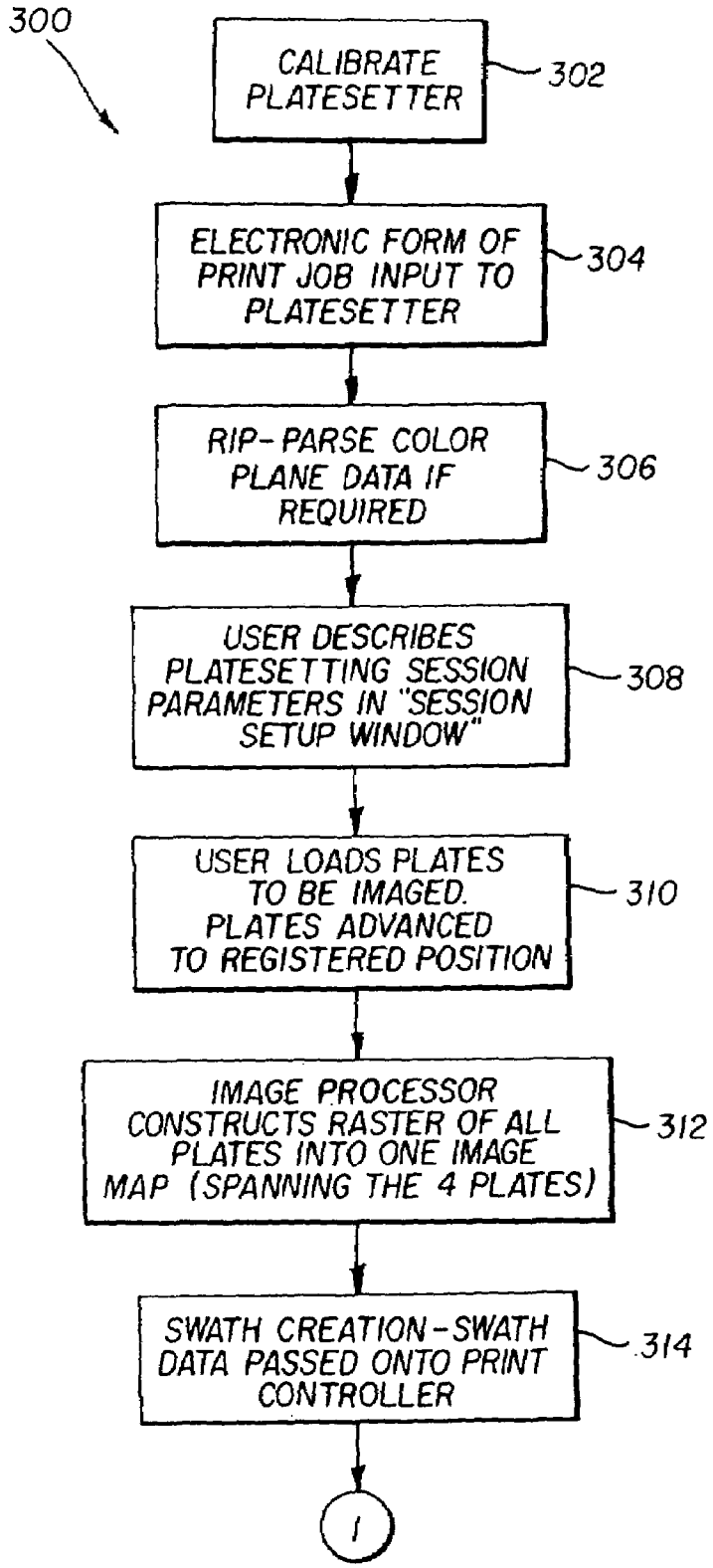
FIGS. 2 and 2*a,b* and *c* are a flowchart illustrating the sequence of events used to image a series of master plates using the imaging system of FIG. 1.
Figure 2:
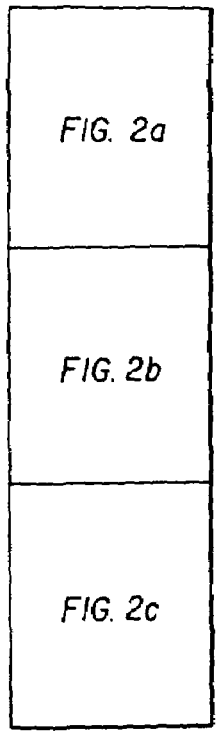
Figure 2B:
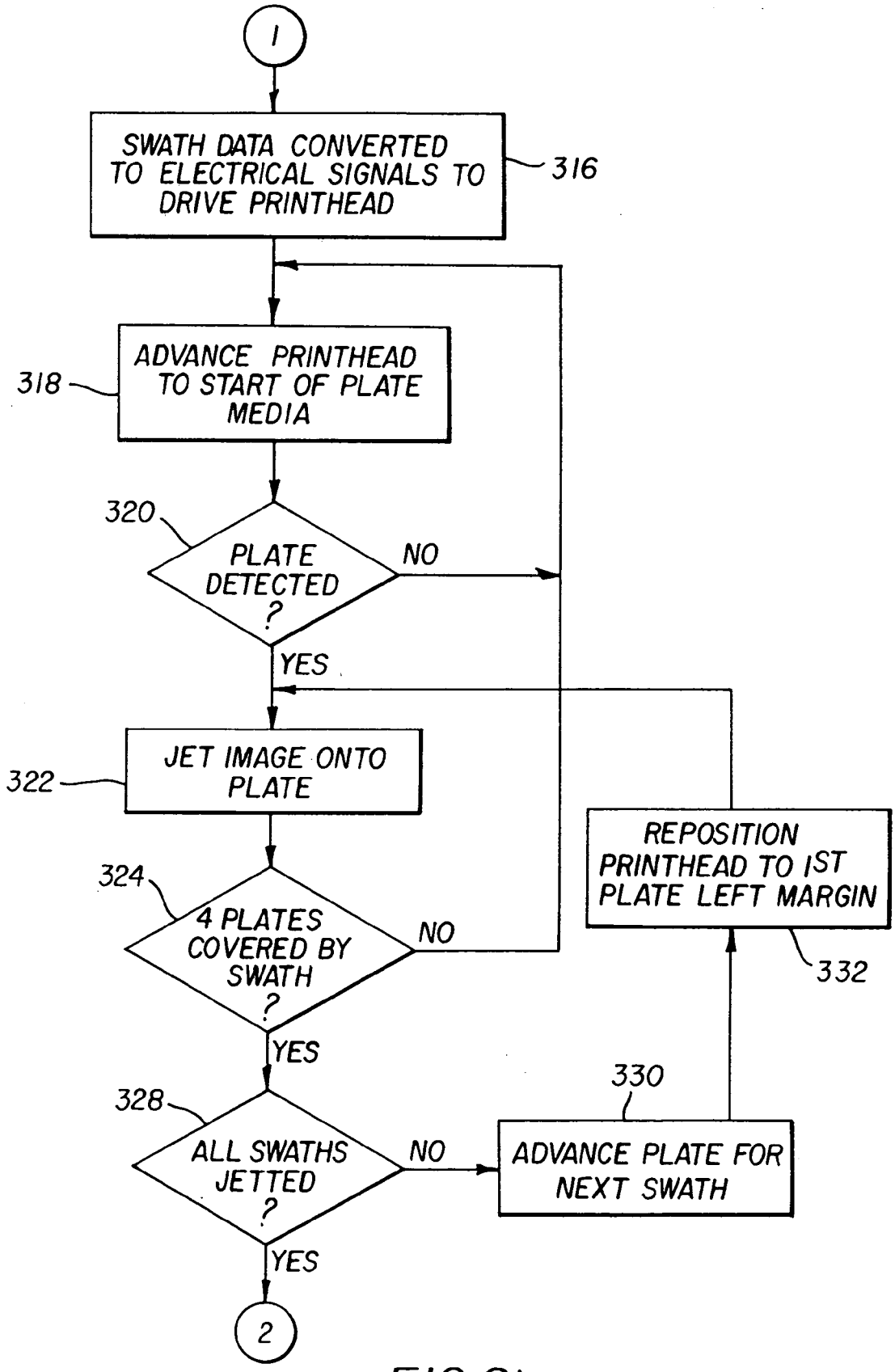
Figure 2C:
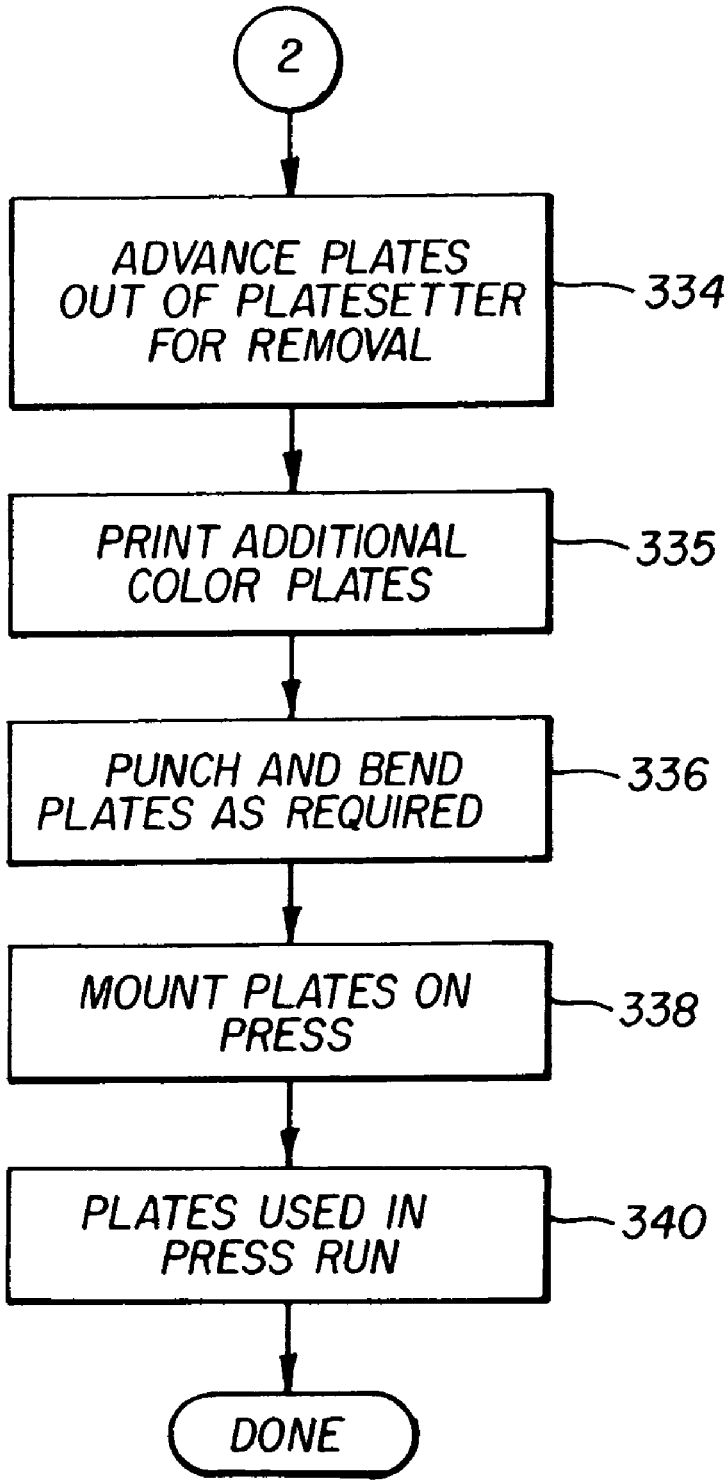

A sequence of events associated with an exemplary process of imaging plates with this imaging system or platesetter is illustrated in the flowchart 300 of FIG. 2. The plate imaging process begins with the user calibrating the platesetter as described below. This step is shown as step 302 in the flowchart—FIG. 2 and detailed steps in the calibration process are illustrated in the flowchart, FIG. 3. After the maximum plate fluid level and tonescale curves have been created, step 302, the platesetter is prepared to image plates for a specific print job, using a particular inkset, plate media, press paper and press. The user then presents images to be imaged onto the lithographic plates by way of the Internet, a local area network, disk media, computer terminal, scanner, digital camera or other suitable source of digital image data, step 304. The image files that are input to the system typically are of POSTSCRIPT™ (page description format) format data but other formats are also possible. If the files do not have each of the color planes available as separated files, the image processor will parse each of the color planes, step 306. The color planes are defined as the process colors (Cyan, Magenta, Yellow, and Black), the HEXACHROME™ (gamut extending colors) colors such as orange and violet, and spot colors such as those in the PANTONE™ (spot colors) portfolio. Although the platesetter can be designed to accommodate any number of lithographic plates; i.e. plural numbers of lithographic plates, to be imaged at once, in this illustrative example the platesetter will be able to image a series of up to four plates at a time in a print pass. The user identifies which color planes will be imaged in an imaging session. An imaging session being defined as the process undertaken to complete the imaging of up to four plates setup in the platesetter. In this illustrative session, the user is to image plates for a print job utilizing process cyan, process magenta, process yellow, process black, PANTONE™ (spot colors) 171 (Peach), and PANTONE™ (spot colors) (72 Reflux blue). The user selects the cyan, magenta, yellow, and black color planes to be imaged in the first imaging session. The two PANTONE™ (spot colors) colors are selected to be imaged in the second session. This information is assembled in a window known as a "Imaging session setup window". Other information tabulated in the "Session Setup Window", step 308, includes screening method used (such as stochastic or halftone), calibration data to be associated with each color plane to be imaged, source of image file, and plate layout (image margins, width, length, and image centering). Once all information is entered in the "Session Setup Window", the platesetter is then ready for imaging. The user loads plate media into the platesetter, step 310, and initiates the processing of the image files. The platesetter uses an electro-optical system 29 (FIG. 4) or other edge detecting system to detect when the lead edges of the plates are in a registered position to be ready for imaging.

The image processor then proceeds to construct a raster spanning the four-color planes, step 312, selected for the first imaging session. In generating this raster, the software adjusts the pixelized data to provide for an adjusted tonescale and maximum plate fluid or liquid limit applied to the specific color for the print job. The image data may also be adjusted for predetermined spacing between the plates so that no data is printed between them. Thus, the image processing may provide for the image data for a raster line of an image to be formed on each of the plates to be combined into a single raster line. Additionally, image data of a page of image data to be formed for each of the master plates may be combined into a single combined page image file before outputting the individual combined raster lines for the series of lithographic plates being imaged. A calibration curve and maximum plate fluid limit is utilized to effectively apply a transfer function to the data as it is rasterized based on the parameters of the press run where the plates will be used. Factors such as type of press ink, press paper, plate type, and use of a particular press influence the character and values of the tonescale calibration curve and the maximum limit for the application of plate fluid onto the plate. The calibration process is discussed in greater detail below.

The rasterized composite image is then passed on to the print controller in swath or pass segments, step 314. The image pixel data from the swath is then converted into electronic signals used to drive the printhead, step 316. The printer controller initiates the laydown of an image swath, step 322, for each of the four plates upon receiving indication that it is at the margin of plate media, step 318. At the left edge of each of the four plates a reflective material strip, for example, is used to flag an optical detector that the print carriage is approaching the start of the plate media. This optical detector is preferably carried on the carriage that supports the printhead 10 so that the printhead and detector move together in the main scanning or fast scan direction in registered relationship. The printer carriage advances the printhead, step 318 until the presence of the reflective strip is detected, step 320. The sequence of advancing the printhead to the next plate and printing that plate's portion of the swath or pass continues until each of the four plates has received a counterpart raster line of an image by the printhead, step 324. Now the plate media is advanced in the feed path to accept the next swath, step 330. It will be understood of course the advancement of the plates in the slow scan direction may also occur after each pass so that a swath of image data is printed in multiple passes as is well known in the inkjet printing arts. The printhead is repositioned to the left margin of the first plate, step 332. In addition printing may also be provided for print passes in both directions. The printing process continues until all swaths of the image have been jetted onto the plate, step 328. Upon completion of plate imaging, the plates are advanced out of the printer carriage area to facilitate removal by the user, step 334. The user now repeats the process for the remaining, if any, color planes to be imaged in the second imaging session, step 335.

A plate is then punched as required for plate bending and to accommodate the press, if it has not already been performed, step 336. After plate bending, the plate is then mounted onto the plate cylinder of the press, step 338, and then utilized to image press sheets, step 340, during a press run. Although registration of each of the lithographic plates can be made with a leading edge thereof registration may be made with other counterpart physical attributes or locators of each lithographic plate such as reference to an edge or edges either at the border or within the plate itself as described below.

Figure 3:
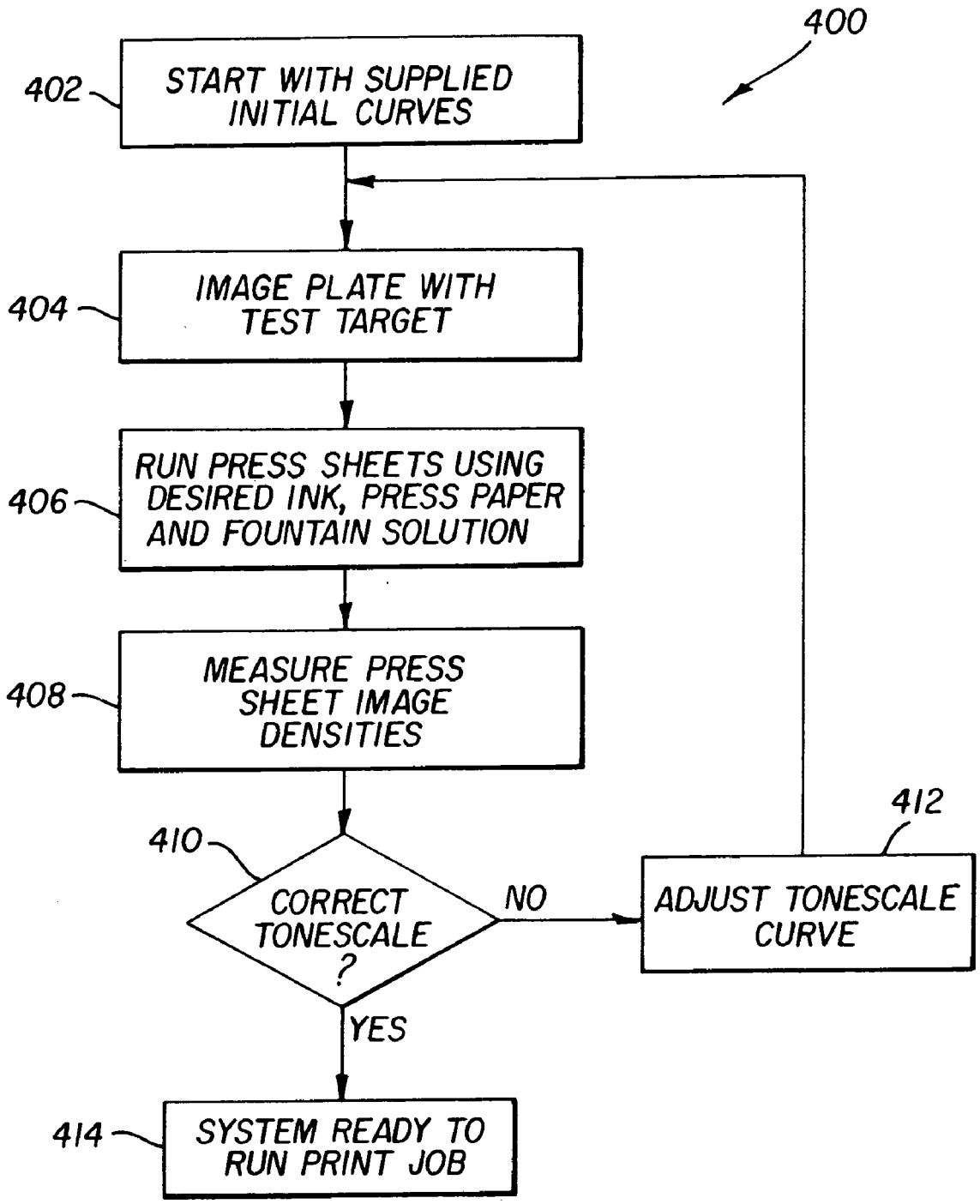
FIG. 3 is a flowchart illustrating a procedure a user may perform to calibrate the imaging system of FIG. 1.

Referring to the flowchart 400 of FIG. 3, the user may create a new tonescale calibration curve and set the maximum limit for the application of plate fluid by entering the calibration mode of the software, which presents the user with a calibration setup page to facilitate the entry of calibration data. The user can either edit data for an existing calibration setup, or initiate the creation of a new calibration setup. If a new calibration setup is desired, the software provides initial condition or starting point tonescale values to be imaged onto a plate (step 402 in FIG. 3). If the user is editing existing calibration data, the test target will be printed using tonescale values entered by the user. For a robust calibration of the platesetter system, press characteristics have to be entered into the calibration. Thus, the user images the test target onto the plate (step 404) and then runs the plates on the target press with target press inks and paper (step 406) Feedback from the press sheets (step 408) are used to generate the calibration data. A sample test target might include uniform printed test patches to be imaged on the press using plates created on the platesetter. This test target contains a series of uniform printed test patches. The density data is read from the patches on the press sheet (in step 408) with the aid of a spectrodensitometer instrument such as the Xrite model 528. The density data to be used to judge whether the setup tonescale curve values are correct. At step 410, the user judges whether there is correct tonescale over the range of percent area covered test patches on the press sheet. If the printed sheet exhibits a range of densities that do not provide a complete tonescale range, the user adjusts the calibration curve data appropriately in step 412. Now using the newly adjusted curve, the plate imaging, printing of the press sheet, and density measurement steps are repeated. If necessary, an adjustment of the calibration curve is again performed. When correct tone scale is obtained the system is ready to run the present print job, step 414.

To aid the user in setting maximum plate fluid level, a test target in the form of circular wedges and text may be provided. Plugging or filling in of the spokes of the wedges or text indicates that an excessive amount of plate fluid is being applied to 100% area coverage or shadow regions of the image.

FIG. 4 illustrates a portion of a mechanical assembly to align a lithographic plate in the ink jet plate setter or imaging system. The transport system is implemented where a series of four lithographic plates 14*a–d* are locked together and moved in unison in the slow scan direction designated by arrow 30 in a wideformat printer, such as a 72" width printer, capable of handling four of 17" wide plates simultaneously. In this way, any transport variation in the slow scan direction will reproduce on all four plates and will not be visible when the separations are printed on the press. The registration in the fast scan direction will also be improved, relative to printing the plates one at a time or on four different printers, since the same printhead transport system will apply to the printing of all four plates.

During the process of imaging, the plate carrier is advanced in the slow scan direction to position the lithographic plates to accept the next swath or pass of inkjet printing. Movement of the plate carrier in the slow scan direction is achieved by the use of a servo motor drive mechanism 26 including a screw drive coupled to the plate carrier for pulling the plate carrier and the graphic plates 14*a–d* forward. Motion controller 27 coordinates positioning and control over the lithographic plates feed path in response to signals from the printer controller 18. Also coordinated are motion of the printhead 10 supported on the carriage support for movement in the main scan direction along a rail 11 so that typically when there is movement of the printhead carriage along the rail the plate carrier 15 and plates 14*a–d* are stationary. Printing of the liquid drops on the lithographic plates may also be made during return movements of the printhead 10. The single printhead in this embodiment provides printing along counterpart raster lines of image data during a pass and thus the counterpart raster lines may be considered printed substantially simultaneously.

Figure 5:
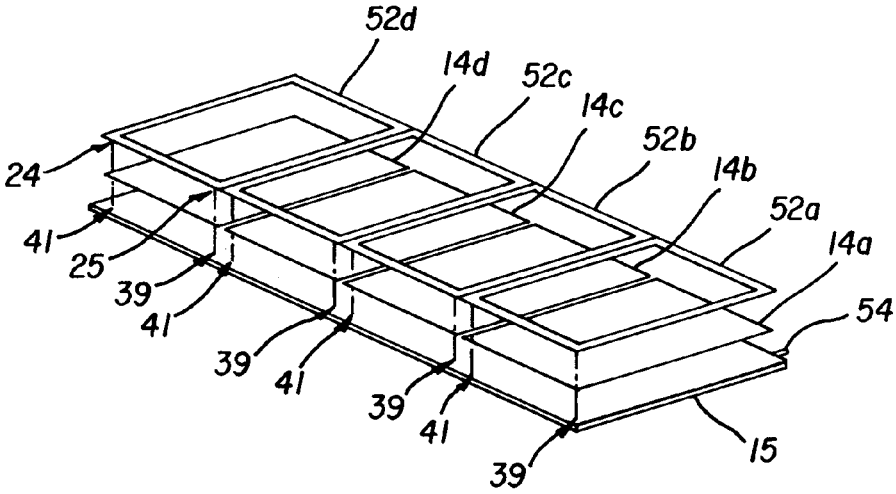
FIG. 5 illustrates an example of a mounting assembly for mounting a series of four lithographic plates upon a plate carrier using pins.

There are many ways in which the lithographic plates may be transported. One example illustrated in FIGS. 5 and 6 would be to mount the four lithographic plates 14*a–d* on a carrier sheet or plate carrier 15 using registration pins 24 and 25 to precisely locate the lithographic plates relative to each other. The two pins are part of a respective plate frame 52*a–d* that covers the perimeter of each of the lithographic plates 14*a–d*, but not the imageble regions of the plate. Each plate frame 52*a–d* is used to assist a vacuum system 54 in the plate carrier 15 to retain the respective lithographic plates flat along the surface of the plate carrier 15. A matrix of holes 58 in the plate carrier 15 beneath the lithographic plates facilitates the vacuum to apply pull to retain the lithographic plate media. The holes 58 access the vacuum system via a vacuum manifold 56 within the plate carrier 15. The lithographic plates are each punched with holes 36 and 37 to accommodate the pins 24 and 25 respectively. Once the lithographic plates are locked in the plate carrier 15, the entire plate carrier 15 can be transported using a suitable drive as described above.

Figure 6:
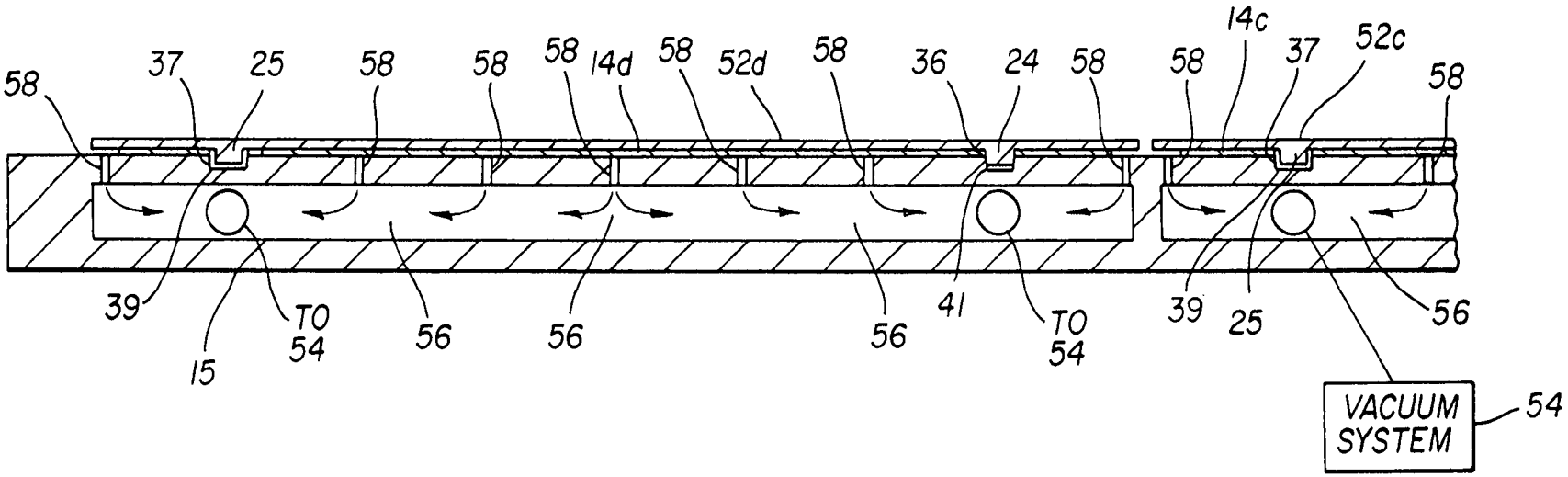
FIG. 6 illustrates a crosssectional view of the mounting assembly of FIG. 5 and showing pins to retain the lithographic plates in registration.
Figure 7:
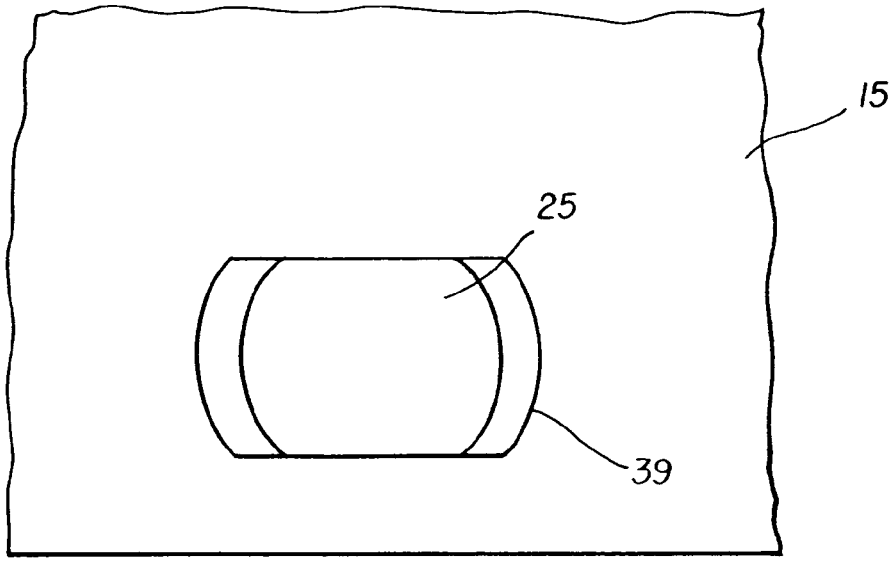
FIG. 7 illustrates a cross sectional view of an oblong pin with respect to its retaining hole in the mounting assembly of FIG. 5.

An example of a pin and hole implementation is shown in FIGS. 6 and 7. In the illustrated example, the respective plate frame 52*c,d* shown are each fabricated from 1/16" thick stainless steel with round pin 24 and oblong pin 25 facing the plate carrier 15. Only two pins are used for insertion near the leading side of the lithographic plates so as not to overly constrain the plate assembly yet prevent motion of the lithographic plate that would degrade image quality. The pins' lengths extend from the plate frame 52*c,d* beyond the lithographic plate and seat in recesses 39, 41 formed in the base of the plate carrier. FIG. 7 illustrates the cross section of the oblong pin 25 with respect to the accepting recess 41 in the plate carrier 15. The plate carrier recess 41 is milled out 1 mm wider on either side of the pin 25 to accommodate tolerances in the assembly materials. Holes 36 and 37 are punched into lithographic plate 14 to accommodate the pins 24 and 25, respectively. The plate carrier 15 is of such height that it does not interfere with the travel of the print head assembly(ies). When plate frame 52 is mounted on the plate carrier 15, the periphery of each counterpart lithographic plate is covered by the respective plate frame with an opening in the respective plate frame for forming an image in the image area of the respective lithographic plate.

Figure 8:
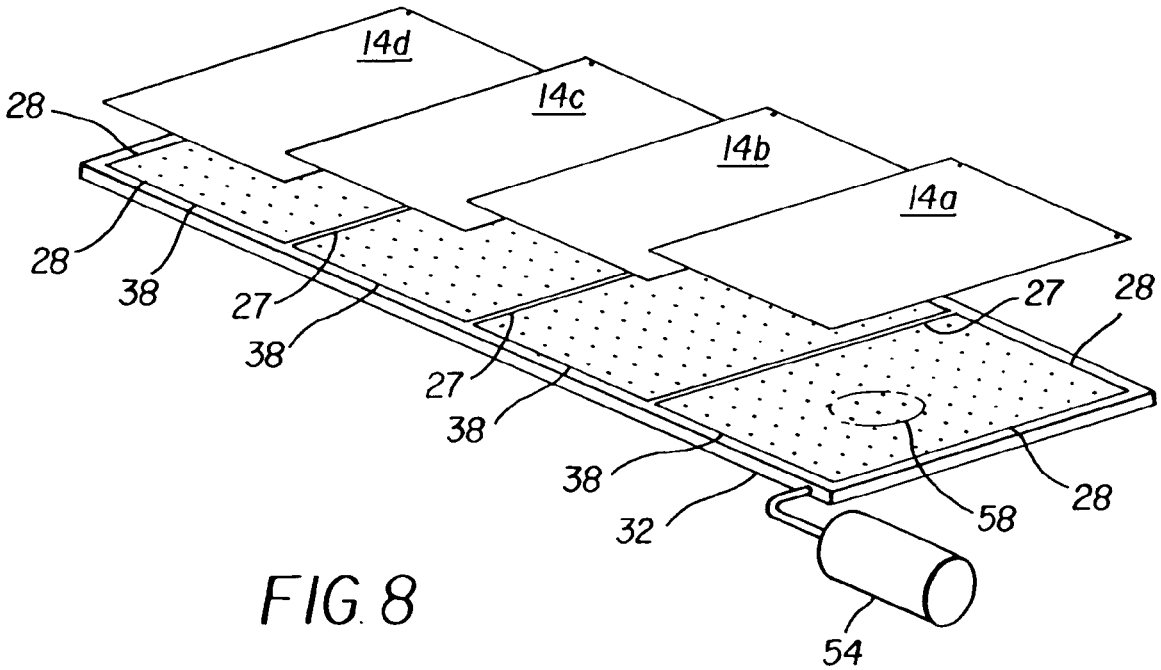
FIG. 8 illustrates the carrier plate that features recessed areas in the carrier plate for location of the respective lithographic plates to be imaged.

An alternative implementation of a plate transport carrier is illustrated in FIG. 8. In this design, four recessed areas 38 of the plate carrier 32 are precisely machined to serve as plate retainers and no pins are utilized for retaining the plates. The sidewalls 27 and peripheral walls 28 of the recessed areas are of such height that the lithographic plates 14*a–d* are secured to hold their registration positions even if there is a small amount of bowing present in the lithographic plates. The plate carrier 32 is designed with vacuum system 54 to pull the lithographic plates flat to the plate carrier. The recessed areas of the carrier have a matrix of holes 58 drilled through to access the vacuum manifold 56 from which a light vacuum is supplied to draw down the back (nonimaging) side of the plate media.

Figure 9:
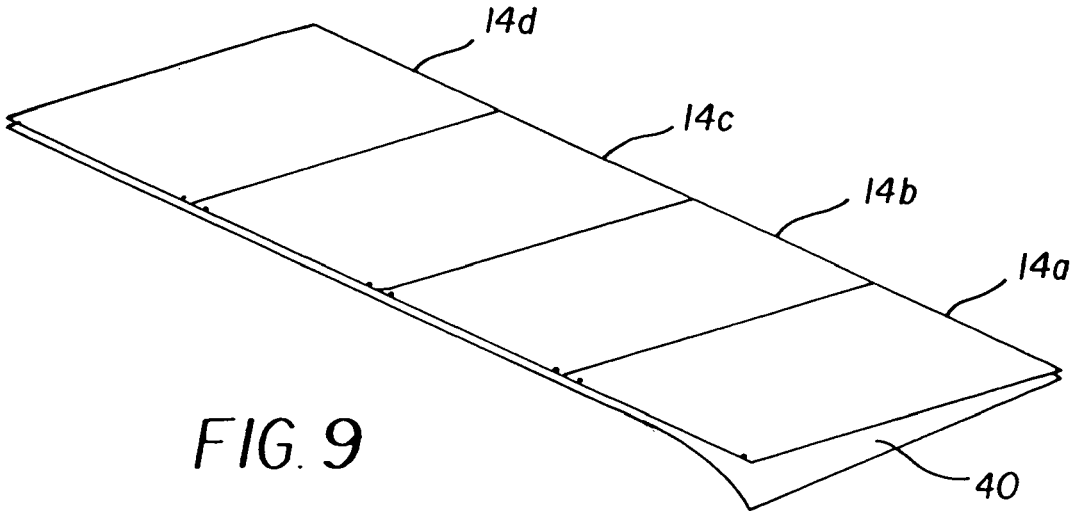
FIG. 9 illustrates lithographic plates affixed to an adhesive backer carrier as a means to retain the lithographic plates in a mutually respective registered position.
Figure 10:
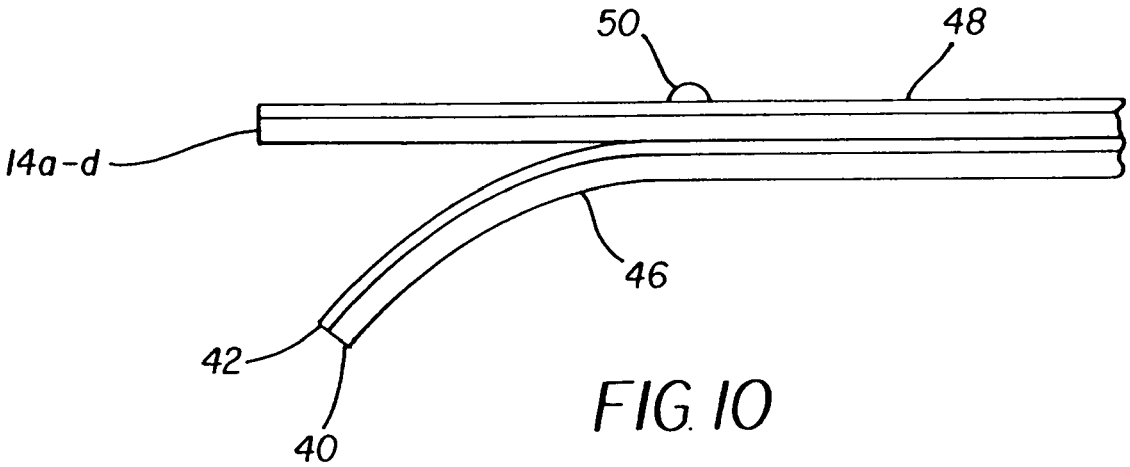
FIG. 10 illustrates a cross sectional view of the plate media assembly shown in FIG. 9.

Still yet another embodiment is to utilize a group of lithographic plates 14*a–d*, in this example the number being four, precut and mounted onto a removable adhesive backer carrier 40. FIG. 9 illustrates this embodiment. The adhesive backer 40 is removed from the rear side of the printing plates after imaging so that the image lithographic plates may be mounted on the printing press. FIG. 10 illustrates a side view of the construction of such a prepared plate media. The individual lithographic plates 14*a–d* are mounted onto the removable backer carrier 40. The removable backer carrier 40 adhering to the precut plates includes a pressure sensitive adhesive layer 42 that is formed on a substrate 46 of the backer carrier 40 so that the adhesive is between the plate media and the backer carrier substrate 46. The pressure sensitive adhesive 42 can be for example, the type used in the manufacture of POST-IT (trademark) brand notes. The imaging side of the lithographic plate has coated thereon a plate fluid-receiving layer 48 upon which image spots 50 may be formed when plate fluid 17 is jetted thereon during imaging of the lithographic plates.

The overall plate assembly would then be loaded into the wide format printer. Imaging would proceed as done for the previous examples. After imaging, the individual plates 14 would then be removed from the adhesive backer carrier 40. The advantage of this method is that a less expensive lithographic plate feed system is required and less precision machining done to the carrier.

Figure 11:
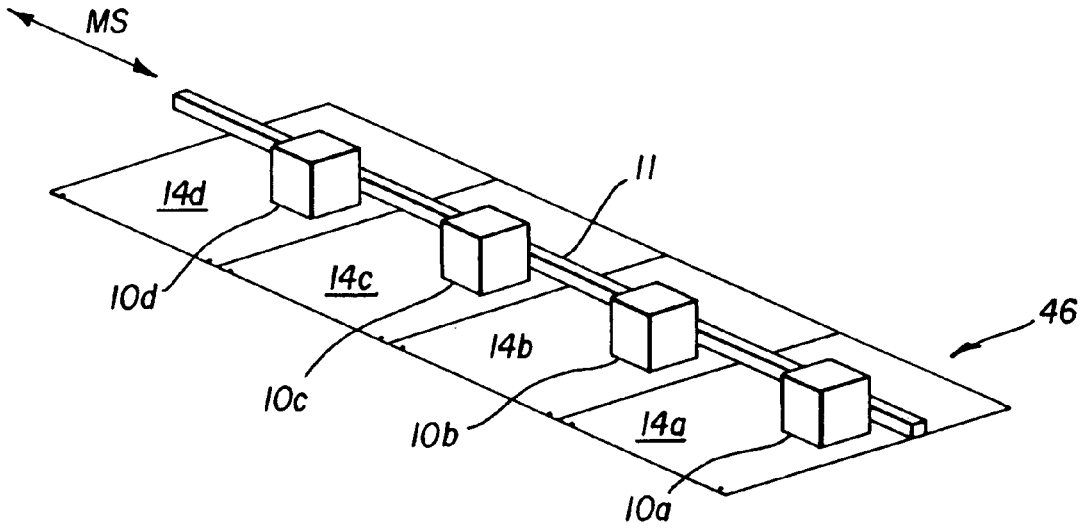
FIG. 11 is an illustration a second embodiment of an imaging system that has 4 inkjet printhead assemblies located on a carriage so that at least one different printhead assembly is printing an image on each lithographic plate simultaneously.

FIG. 11 shows an alternative embodiment where the printing system has four printhead assemblies 10 each located on a respective carriage so that at least one printhead assembly is printing each plate simultaneously. This will allow for a nearly a 4× increase in print speed vs. printing one plate at a time by a single printhead assembly that scans across all four plates and thus prints all 4 plates substantially simultaneously during a single sweep. Any small errors in head to head spacing will show up as image to plate registration errors, which is correctable. Any errors in transport of the four head assemblies, which are locked together for movement along a common rail 11, will result in low differential errors and little or no resulting registration defects. The printheads 10*a*–10*d* move in the main scan direction along the common rail 11 to each printing counterpart raster row or line pixels on a respective lithographic plate so that the counterpart raster lines for the series of plates preprinted simultaneously. It will be understood that for each of the printheads 10*a*–10*d* plural raster lines may be printed simultaneously by each printhead during the pass, see aforementioned U.S. Pat. No. 6,464,330.

Figure 12:
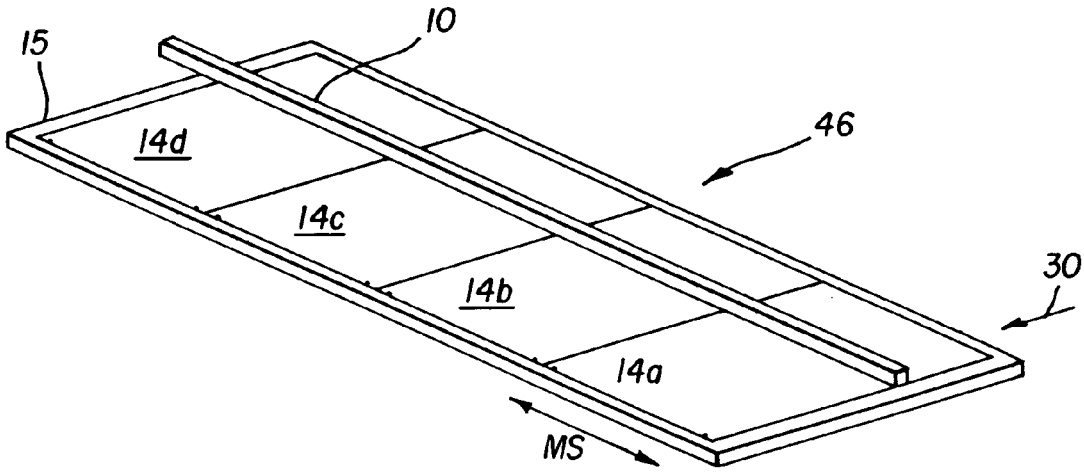
FIG. 12 is an illustration of a third embodiment of an imaging system that has a single page wide inkjet printhead assembly so that one printhead assembly is used to print the counterpart raster line of an image on each of the four lithographic plates simultaneously.

With reference now to FIG. 12, there is illustrated a printer system for imaging four lithographic plates 14*a*–*d* using a full width printhead 10 which extends in the main scan direction (MS) for the full width of the assembled four lithographic plates. The printhead 10 is stationary and the carrier 15 with the four lithographic plates mounted thereon are moved in the sub-scan direction 30 using a mechanism similar to that illustrated in FIG. 4. The plate carrier may take the form of those illustrated above in the other illustrative embodiments. In this embodiment, all the recording elements are adapted to be actuated simultaneously to print a respective counterpart raster row upon each lithographic plate. Of course, for any raster row, a particular recording element is actuated to jet a drop onto the plate in accordance with the image to be recorded for that plate. It is also contemplated that two dimensional (2D) printers may be used that are full width and full length to print entire images on the series of master lithographic plates simultaneously.

Another hardware feature that can be added on to the inkjet printer is capability to punch alignment holes on the input side of the printer. The alignment holes serve two purposes, one set to align the plate for the plate bending fixture, and the other to match with the alignment pins on the plate drum that fix the plates position on the drum at time of plate loading. It is common practice for lithographic printing presses to utilize a plate mounting-auto loading feature which includes the use of pins to restrain and at the same time fix the plate in an aligned position such that the press man can align the plate into registration using either manual or automated means of registration. After all the plates for a four color process print job are mounted on this press the press man will proceed to bring the plates into register utilizing the plate positioning function built into the press. The pressman uses a standard test target usually imaged outside of the deliverable image on the plate as a guide to which color plates are to what degree out of registration. The user may punch alignment holes for the use of the plate bender fixture and press in the plate before or after imaging on another fixture designed for that function. Alternatively, the plate carrier described above can install upon a plate-punching fixture at the input side 46 of the printer and operate with a plate punching mechanism to punch holes prior to imaging the plate. The plate punching mechanism would have retractable die to cut holes into the plate media. The carrier would have restraining hardware built into it to hold the plate in a fixed position during the punching operation and during the imaging operation.

While this invention has been described with reference to illustrative embodiments, this description is not intended to be construed in a limiting sense. For example, the principles of the invention can be applied to other types of recording elements, such as LEDs, thermal recording elements, lasers, and other recording element configurations. In the example where a printhead operates to expose the lithographic plate using light emitted from a printhead or printheads, the printhead or printheads can be used to expose counterpart raster lines on each of four master plates carried by a carriage and can perform this function in similar fashion to that described for the inkjet printhead. Additionally, thermal recording printhead(s) may also be used as the imaging element for forming an image on each of the lithographic or flexographic plates or to similar type master plates. In still further modifications of the invention, plural lithographic plates registered relative to each other and supported by a plate carrier structure that is held fixed may be imaged while a printhead is moved bidirectionally in two dimensions such as a plotter to apply the images to the plates. In yet a further modification of the invention, the printhead may be held fixed and a plate carrier supporting the plural lithographic plates registered relative to each other is moved in two dimensions so that the images are printed on to the plates. Encoders and other process control elements may be used to control movement of the printhead relative to the plates as is well known for recording an image onto a recording sheet using an inkjet printer or the like.

Thus, various modifications and combinations of the illustrative embodiments, as well as other embodiments of the invention, will be apparent to persons skilled in the art upon reference to the description. It is, therefore, intended that the appended claims encompass any such modifications or embodiments.

What is claimed is:

1. A method of producing images on a series of master plates that are suitable for use as printing plates for the reproduction of multiple copies of composite images from said plates, the method comprising:

supporting the plates with a predetermined alignment; and printing a counterpart raster line of an image on each of the series of master plates so that counterpart raster lines for the series of master plates are printed simultaneously or substantially simultaneously and are printed in alignment wherein the counterpart raster lines on the series of master plates are printed by a single printhead.

2. The method of claim 1 and wherein the printhead ejects liquid onto the master plates to form respective images thereon.

3. The method of claim 1 and wherein the printhead emits light to expose the images on the master plates.

4. The method of claim 1 and wherein the printhead is a page wide printhead that prints the counterpart raster lines on the series of master plates simultaneously.

5. The method of claim 4 and wherein the printhead ejects liquid onto the master plates to form respective images thereon.

6. The method of to claim 4 and wherein the printhead emits light to expose the images on the master plates.

7. The method of claim 1 and wherein the printhead is a scanning printhead supported on a carriage that traverses along the rail in the direction of alignment of the raster lines and the printhead prints counterpart raster lines substantially simultaneously on the master plates during a sweep across the rail.

8. The method of claim 7 and wherein the printhead ejects liquid onto the master plates to form respective images thereon.

9. The method according to claim 7 and wherein the printhead emits light to expose the images on the master plates.

10. The method of claim 1 and wherein plural printheads are mounted on the same carriage and the plural printheads traverse along the rail in the direction of alignment of the raster lines and each of the printheads prints on a respective one of the master plates.

11. The method of claim 10 and wherein the printheads eject liquid onto the master plates to form respective images thereon.

12. The method of claim 10 and wherein the printheads emit light to expose the images on the master plates.

13. A method of printing composite images of plural colors using the master plates formed in claim 1, the method comprising:

(a) forming respective images on the series of master plates in accordance with the method of claim 1;

(b) subsequent to step (a) mounting the series of master plates on respective printing cylinders or supports and applying respective different color inks to the respective master plates to establish selective imagewise color inking of the respective master plates; and (c) transferring respective images from the inked respective master plates to a receiver sheet to form a composite multicolored image thereon.

14. The method of claim 1 and wherein image data for a raster line of an image to be formed on each of the master plates is combined into a single raster line.

15. The method of claim 1 and wherein image data of a page of image data to be formed on each of the master plates is combined into a single combined page image file.

16. The method of claim 15 and wherein a single printhead prints the combined image file of data on the series of master plates.

17. The method of claim 1 and wherein the master plates comprise lithographic plates.

18. The method of claim 1 and wherein the master plates are supported on a common carrier for the plates during forming of images on the plates.

19. The method of claim 18 and wherein the master plates are held on the common carrier by an adhesive.

20. A method of producing images on a series of master plates that are suitable for use as printing plates for the reproduction of multiple copies of composite images from said plates, the method comprising:

supporting the series of master plates with a respective leading edge of each plate being in alignment; and printing a counterpart raster line of an image on each of the master plates so that counterpart raster image lines are in alignment wherein the printer is arranged to print the counterpart raster line of the image on each of the master plates using one printhead to form images on the series of master plates.

21. An apparatus for producing images on a series of master plates that are suitable for use as printing plates for the reproduction of multiple copies of composite images from said plates, the apparatus comprising:

a support supporting the series of master plates with a predetermined alignment; and a printer adapted to print a counterpart raster line of an image on each of the master plates simultaneously or substantially simultaneously so that counterpart raster lines of the series of master plates are printed in alignment wherein the printer is arranged to print the counterpart raster line of the image on each of the master plates using one printhead to form images on the series of master plates.

22. The apparatus of claim 21 and wherein the printhead is a page wide printhead that extends for a width equal to or greater than the width of the series of master plates.

23. The apparatus of claim 22 and wherein the printhead ejects liquid onto the master plates to form respective images thereon.

24. The apparatus of claim 22 and wherein the printhead emits light to expose the images on the master plates.

25. The apparatus of claim 21 and wherein the printhead ejects liquid onto the master plates to form respective images thereon.

26. The apparatus of claim 21 and wherein the printhead emits light to expose the images on the master plates.

27. The apparatus of claim 21 and wherein the printer includes a scanning printhead supported on a carriage that traverses along the rail in the direction of alignment of the raster lines and the printhead prints counterpart raster lines substantially simultaneously on the master plates during a sweep across the rail.

28. The apparatus of claim 21 and wherein the printer includes plural printheads that are mounted on the same carriage and the plural printheads are adapted to traverse along the rail in the direction of alignment of the raster lines and each of the printheads prints on a respective one of the master plates.

* * * * *